US006672956B1

(12) United States Patent
Michael

(10) Patent No.: US 6,672,956 B1
(45) Date of Patent: Jan. 6, 2004

(54) APPARATUS FOR VENTING CHEMICAL VESSELS

(75) Inventor: Rizik Michael, San Jose, CA (US)

(73) Assignee: Integrated Engineering Services, San Jose, CA (US)

( * ) Notice: Subject to any disclaimer, the term of this patent is extended or adjusted under 35 U.S.C. 154(b) by 11 days.

(21) Appl. No.: 10/128,194

(22) Filed: Apr. 22, 2002

(51) Int. Cl.[7] ..... B67C 7/00
(52) U.S. Cl. ..... 454/370; 454/49
(58) Field of Search ..... 454/49, 63, 64, 454/67, 370

(56) References Cited

U.S. PATENT DOCUMENTS

| | | | | | |
|---|---|---|---|---|---|
| 1,552,316 | A | * | 9/1925 | Krieg | 454/49 |
| 1,852,299 | A | | 4/1932 | Gray et al. | |
| 3,368,324 | A | * | 2/1968 | Leedy | 53/247 |
| 3,372,716 | A | * | 3/1968 | Hommel et al. | 141/59 |
| 3,789,109 | A | | 1/1974 | Lyon et al. | |
| 4,249,785 | A | | 2/1981 | Hapgood et al. | |
| 4,345,615 | A | | 8/1982 | Di Cicco et al. | |
| 4,579,569 | A | | 4/1986 | Sheng et al. | |
| 4,632,022 | A | | 12/1986 | Baitinger et al. | |
| 4,857,949 | A | | 8/1989 | Masuda et al. | |
| 5,265,117 | A | * | 11/1993 | Pernet et al. | 373/9 |
| 5,449,398 | A | | 9/1995 | Motoda | |
| 5,451,321 | A | | 9/1995 | Matkovich | |
| 5,863,436 | A | | 1/1999 | Matkovich | |

* cited by examiner

*Primary Examiner*—Harold Joyce
(74) *Attorney, Agent, or Firm*—Christopher J. Palermo; Hickman Palermo Truong & Becker LLP

(57) ABSTRACT

A venting apparatus for chemical containers comprises a vent duct having a plurality of vent ports, a flow control mechanism, and a damper. A closure of a chemical container is coupled to one of the vent ports using suitable tubing, and a second coupling connects the chemical container to equipment that uses the contents of the container. A distal end of the vent duct is coupled to an exhaust fan. In this configuration, vapors evaporating from the contents of the chemical are safely exhausted outside a work facility. As a result, a chemical container that normally would be classified as Use-Open under applicable fire codes is converted to Use-Closed, effectively enabling the work facility to substantially increase the volume of chemicals that may be contained or used in the facility under the code, without requiring upgrade of existing facilities to Hazardous Occupancy standards, or building new facilities that qualify as Hazardous Occupancy and that can use Use-Open chemical containers. Thus, unnecessary and erroneous capital investments for upgrading existing facilities, or building new facilities to support the operation, are avoided. Evaporation of chemicals from the chemical container into the environment is reduced, and hazardous chemical vapors are removed from the occupied environment and directed them to an approved location, thus enhancing the environment and air quality within the space.

37 Claims, 12 Drawing Sheets

11
65
62
64
12b
11
14
16
18
22
12a
SECTION A 24b
12
14
16
18
20
CHEMICAL BOTTLE
22
12a
30
50
40
34
32
10
24a

SECTION F

SECTION G

APPARATUS FOR VENTING CHEMICAL VESSELS

FIELD OF THE INVENTION

The present invention generally relates to chemical venting and handling apparatus. The invention relates more specifically to an apparatus for venting chemical vessels.

BACKGROUND OF THE INVENTION

In many jurisdictions, the use and storage of hazardous or flammable chemicals is controlled by laws and regulations. For example, use and storage of flammable chemicals, such as flammable solvents and similar materials, is closely regulated. These laws and regulations also control what kind of buildings and workplaces a business entity may use to store and use the chemicals.

For example, the California Fire Code (CFC) and the California Building Code (CBC) impose such regulations. Under CBC, building facilities used by business entities are classified, among other classifications, as B-2, F, and H-3. Such classifications may apply to entire buildings or to selected control zones within a single facility. B-2 and F classifications are for general office and light industrial uses. H-3 is a hazardous facility classification. In general, a business entity occupying a B-2 or F facility faces far lower costs of occupancy and fewer regulatory controls than in an H-3 facility. Further, most jurisdictions provide zoning for H-3 facilities only in limited areas, whereas B-2 or F facilities are more widely allowed under zoning regulations.

CBC and CFC, Section 222-U, define such storage as either "Use Closed Systems" or "Use Open Systems." Generally, a Use Closed System is one in which a vessel holding the hazardous chemical is closed or sealed continuously throughout use of the chemical, such that vapors emitted by the chemical are not liberated outside of the vessel or system and the chemical is not exposed to the atmosphere during normal operations. A Use Open System is one in which the vessel is continuously open in whole or in part during normal operations, such that vapors evaporating from the vessel are liberated may enter the building atmosphere.

A B-2 or F facility may have only limited quantities of chemicals that are defined as Use Open Systems; at present, the limit is a total of 30 gallons per control area in a facility, and each B-2 or F facility may have up to four (4) such control areas. However, the threshold for Use Closed Systems is much higher; at present, it is 120 gallons per control area. Above these threshold amounts, an expensive H-3 facility is required. Therefore, if a business entity needs to have more than 30 gallons of hazardous chemicals on hand for its operations, and the business entity is able to use only Use Closed Systems, it can successfully conduct its operations in a B-2 or F facility. If it only Use Open Systems are available, then the same entity would have to occupy an H-3 facility.

One context in which these regulations are important is the operation of highpressure liquid chromatography (HPLC) equipment, which is widely used in biotechnology. Business entities that use HPLC equipment are often severely limited in the number of HPLC machines that they can operate within a B-2 or F control zone. While these entities would be more successful if they could operate more HPLC equipment, the entities do not wish to incur the costs of changing to an H-3 facility or control zone.

These issues also exist in jurisdictions other than California that are subject to the code of the National Fire Protection Agency (e.g., NFPA30) and the International Fire Code (IFC). The NFPA applies to the United States, Puerto Rico and the Virgin Islands; the IFC is in force in certain East Coast U.S. states, and the UFC is in force for certain West Coast states.

Accordingly, there is a need in this field for a way to conveniently, efficiently and inexpensively convert various chemical vessels from Use Open Systems to Use Closed Systems. Such a solution would allow certain business entities to have up to 120 gallons of Flammable-1B chemicals within each B-2 or F occupancy control area. In turn, such a solution would allow such entities to quadruple the quantity of chemicals that they can have within a B-2 or F occupancy, and to avoid building costly H-3 Hazardous occupancy building, which significantly increases construction cost.

A specific need in this context is to reduce the evaporation of chemicals from existing chemical vessels, bottles or other containers into the environment.

Still another related need is to provide a way to remove hazardous chemical vapors from the occupied environment and to direct them to an approved location, thus enhancing the environment and air quality within the occupied space.

Based on the foregoing, there is a clear need in this field for an apparatus for venting chemical vessels.

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

SUMMARY OF THE INVENTION

The foregoing needs, and other needs and objects that will become apparent for the following description, are achieved in the present invention, which comprises, in one aspect, a venting apparatus for chemical bottles. The apparatus comprises a vent duct; a plurality of vent ports in spaced-apart locations in the vent duct, wherein each of the vent ports is adapted for coupling to a chemical storage vessel; a flow control mechanism disposed in the vent duct downstream from the vent ports; and a damper disposed in the vent duct downstream from the vent ports.

According to one feature, a closure of a chemical bottle is coupled to one of the vent ports using suitable tubing, and a second coupling connects the chemical bottle to equipment that uses the contents of the bottle. A distal end of the vent duct is coupled to an exhaust fan or room ventilating system.

In this configuration, vapors evaporating from the contents of the chemical are safely exhausted outside a work facility. As a result, a chemical bottle that normally would be classified as Use-Open under applicable fire codes is converted to Use-Closed, effectively enabling the work facility to substantially increase the volume of chemicals that may be stored in the facility under the code, without requiring storage in a hazardous-occupancy facility. Evaporation of chemicals from the chemical bottle into the environment is reduced, and hazardous chemical vapors are removed from the occupied environment and directed to an approved location, thus enhancing the environment and air quality within the space.

In another aspect, the invention provides a workplace furnishing having an integrated venting apparatus. The furnishing and apparatus comprise a frame having one or more surfaces for supporting one or more chemical storage vessels; a vent duct affixed to the frame; a plurality of vent ports in spaced-apart locations in the vent duct, wherein each of the vent ports is adapted for coupling to a chemical storage vessel; a flow control mechanism disposed in the vent duct downstream from the vent ports; and a damper disposed in the vent duct downstream from the vent ports.

Specific embodiments are useful for converting chemical containers from Use-Open to Use-Closed, as defined by the 1998 California Fire Code, the 1997 and 2000 Uniform Fire Code ("UFC"), and any codes subsequently adopted by California based on the 2000 UFC, thus allowing laboratories or other work facilities to have up to 120 gallons of Flammable-1B chemicals within each B-2 or F occupancy control area. This allows the laboratories or work facilities to quadruple the quantity of chemicals and the number of chemical processing apparatus that they can have within a facility that is classified for B-2 or F occupancy, and to avoid building costly H-3 Hazardous occupancy building, which significantly increases construction cost. Embodiments also reduces the evaporation of chemicals from the chemical bottle into the environment, and remove hazardous chemical vapors from the occupied environment and directs them to an approved location, thus enhancing the environment and air quality within the space.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE PREFERRED EMBODIMENT

A venting apparatus is described. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

In one embodiment, a venting apparatus for chemical bottles comprises a vent duct having a plurality of vent ports, a flow control mechanism, and a damper. A closure of a chemical bottle is coupled to one of the vent ports using suitable tubing, and a second coupling connects the chemical bottle to equipment that uses the contents of the bottle. A distal end of the vent duct is coupled to an exhaust fan or room ventilation system.

In this configuration, vapors evaporating from the contents of the chemical are safely exhausted outside a work facility. As a result, a chemical bottle that normally would be classified as Use-Open under applicable fire codes is converted to Use-Closed, effectively enabling the work facility to substantially increase the volume of chemicals that may be stored in the facility under the code, without requiring storage in a hazardous-occupancy facility. Evaporation of chemicals from the chemical bottle into the environment is reduced. Further, hazardous chemical vapors are removed from the occupied environment and directed to an approved location. This enhances the environment and air quality within the space.

Specific embodiments are useful for converting chemical containers from Use-Open to Use-Closed, as defined by the 1998 California Fire Code, the 1997 and 2000 Uniform Fire Code ("UFC"), and any codes subsequently adopted by California based on the 2000 UFC. Since the limit on storage of Use-Open chemical bottles is 30 gallons per control area with up to four (4) control areas permitted, the apparatus herein effectively allows the laboratories or work facilities to quadruple the quantity of chemicals and the number of HPLC or other chemical processing apparatus that they can have within a facility that is classified for B-2 or F occupancy, and to avoid building costly H-3 Hazardous occupancy building, which significantly increases construction cost. Embodiments also reduces the evaporation of chemicals from the chemical bottle into the environment, and remove hazardous chemical vapors from the occupied environment and directs them to an approved location, thus enhancing the environment and air quality within the space.

Figures 1A, 1B:
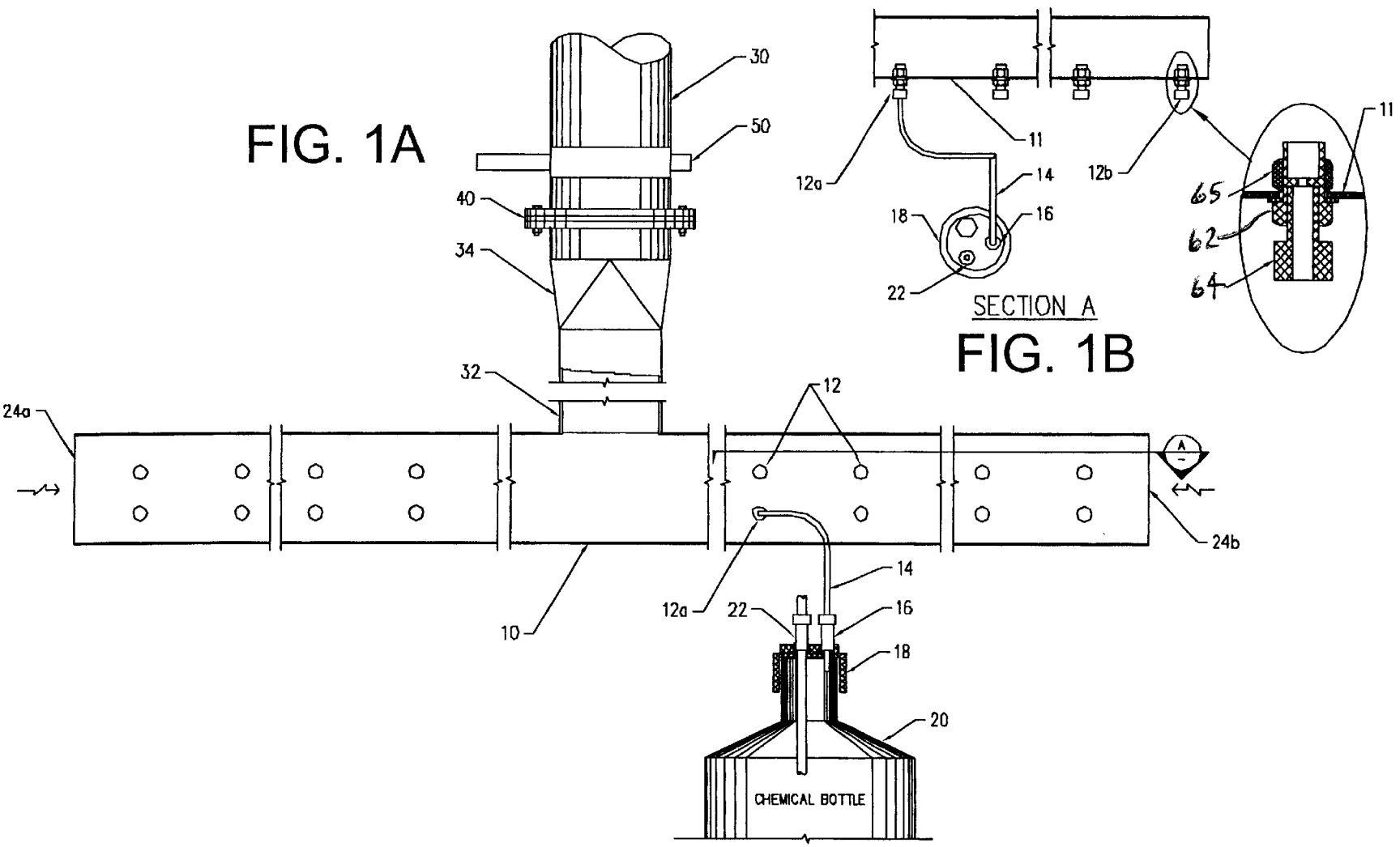
FIG. 1A is a front elevation view of a venting apparatus, according to a first embodiment.
FIG. 1B is a top partial section view of the embodiment of FIG. 1A, taken along line A of FIG. 1A.

FIG. 1A is a front elevation view of a venting apparatus, according to a first embodiment. FIG. 1B is a top partial section view of the embodiment of FIG. 1A, taken along line A of FIG. 1A.

Referring first to FIG. 1A, a first embodiment of a venting apparatus comprises a vent duct header 10 and vertical, elongated exhaust duct 30. Vent duct header 10 is formed as a generally linear, elongated tube having a rectangular or circular cross-section, and comprises a plurality of vent ports 12 that are disposed in spaced-apart locations in the vent duct. Each of the vent ports is adapted for coupling to a chemical storage vessel 20. For example, vent port 12*a* is coupled by flexible tubing 14 to a fitting 16 that is sealed and affixed to a cap 18 on chemical storage vessel 20. Cap 18 may be attached with a press-fit on a neck of vessel 20 and sealed thereon using an O-ring. The vessel 20 may comprise a chemical supply storage bottle, a waste container, etc.

Vent duct header 10 further comprises first and second proximal ends 24*a*, 24*b* that are open to ambient atmosphere within a workspace .that contains the venting apparatus. A distal end of exhaust duct 30 terminates at a room ventilation system, exhaust fan or other exhaust mechanism that is located adjacent an external environment or atmosphere. A fan rated for airflow of approximately 10 to 50 cubic feet per minute (CFM) is suitable. In this arrangement, vapors developed within the chemical storage vessel 20 are drawn through tubing 14, one of the vent ports 12, vent header 10, exhaust duct 30, and thereby exhausted outside the workspace. Proximal ends 24*a*, 24*b* facilitate draft in the system, and may be provided with suitable air-permeable fittings to cover and prevent damage to the vent header or injury to operating personnel, while permitting room air to pass through, such as end caps having a plurality of perforations, slots, screens, grates, round holes, etc.

As seen in FIG. 1B, vent ports 12 extend through and are attached in wall 11 of vent header 10. As illustrated in the case of vent port 12*b*, each vent port may comprise a threaded bulkhead union or fitting 62 that extends through wall 11 and is retained snugly against the wall by a threaded nut 65. In this configuration, tubing 14 is held in compression within fitting 62 by another nut 64, providing a sealed connection from vessel 20 to vent header 10. In one embodiment, the combination of fitting 62 and nut 65 comprise an Upchurch Scientific No. P440, P441, or P442 bulkhead union, or any other device that has equivalent physical characteristics. Fitting 62 and nuts 64, 65 may be formed of polyetheretherketone (PEEK) material, polypropylene, or stainless steel.

Cap 18 on vessel 20 may have one or more additional fittings 22 that terminate at chemical processing equipment (not shown). In one specific embodiment, a fitting 22 is coupled by suitable tubing to a high-pressure liquid chromatography apparatus, which draws solvents or other chemicals from vessel 20 into the apparatus for use within it. In one embodiment, as an example, cap 18 comprises three (3) ¼"×28 threaded ports and is screwed onto the neck of vessel 20. A first port is used for chemical suction by an HPLC unit or other chemical consuming equipment, via diameter Teflon dip tubing. A second port is provided for other HPLC or other chemical processing functions. The third port is coupled to vent header 10 by tubing 14.

In one embodiment, tubing 14 comprises Teflon material. The diameter of tubing 14 and an orifice in fitting 62 may be, for example, approximately 1/64" to 1/16" diameter for HPLC applications, and up to approximately 3" for other applications using various chemical containers. These dimensions are not critical or required, and the actual dimensions that are used may vary depending on the size of the chemical container and on the chemical fill or draw rate.

In HPLC applications, use of relatively small-diameter parts restricts the flow of vapors from the vessel 20 into the ventilation system, in order to minimize evaporation of liquids from the vessel that may be induced by the draft and suction force provided by the ventilation system or exhaust fan. This reduces waste of chemicals in vessel 20, which are typically expensive; further, this maintains the concentration of chemicals in vessels 20, which provides a means for maintaining reliable HPLC analysis results.

In the example embodiment of FIG. 1A, vent header 10 is aligned in a generally horizontal position. The vent header 10 is joined to exhaust duct 30 by an upstanding segment 32 and rectangular-to-circular transition section 34. The transition section 34 serves to adapt vent header 10, which has a rectangular cross-section, to mate to exhaust duct 30, which has a circular cross-section. Transition section 34 may be fastened to vent header 10 using self-tapping screws, or by tack welding, or any other mechanically equivalent method, and sealed thereon using chemical resistive flexible caulk.

Duct section 32 may be of any length, and may join vent header 10 at any point along the length of the vent header. The vent header 10 may have any desired length, and may be formed in a plurality of elongated segments that are joined using suitable joining plates, or short adapter segments that snugly telescope into longer vent header segments, or ends that snugly mate with one another, or any other mechanical joining technique. Such adapter segments may have hanger brackets formed integrally thereon to engage corresponding slots in, or to be mechanically fastened to, units 80*a*, 80*b* of FIG. 5A. The vent header may be formed of two (2) "L"-shaped front and rear panels that interlock to form a closed rectangular tube, and are affixed tabs that engage corresponding slots, or using fasteners such as sheet metal screws.

As an alternative to using transition section 34, vent header may terminate in a closed end having an exhaust port. The exhaust port may be coupled by tubing to a corresponding port in a closed end of the exhaust duct 30 upstream from the flow control mechanism 40. This alternative is suitable when the installation environment requires separation of the vent header from the exhaust duct, or when there is a need to provide a removable vent header.

Figure 2B:
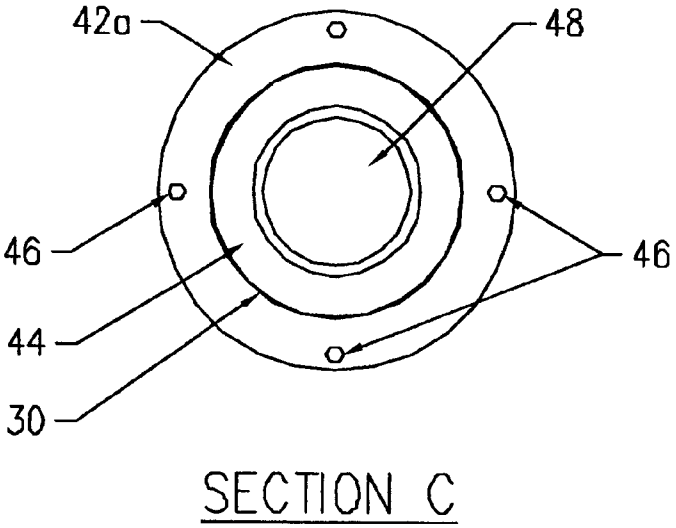
FIG. 2B is a section view of the apparatus of FIG. 2A, taken along section line C of FIG. 2A.
Figure 2A:
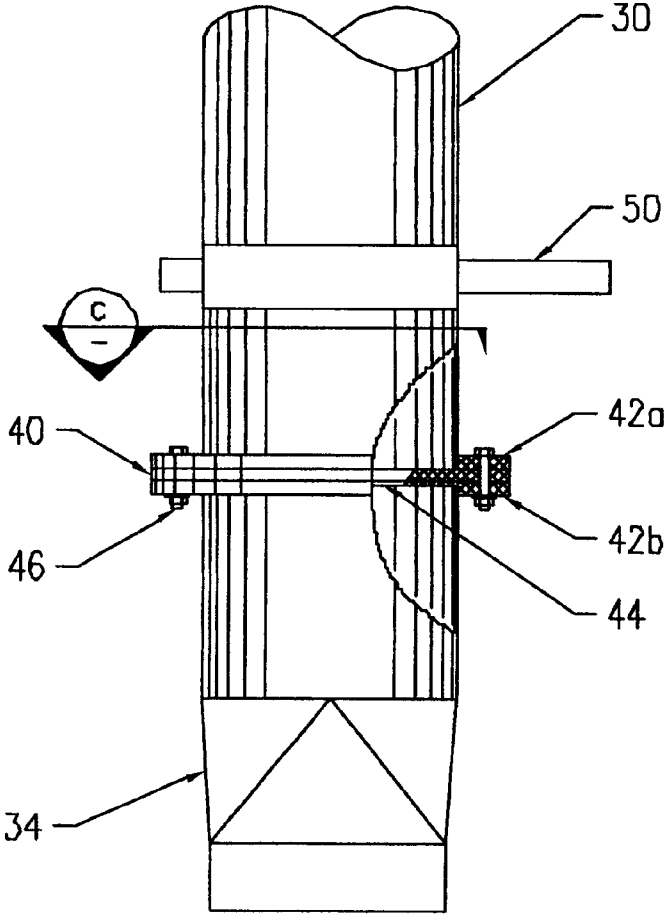
FIG. 2A is a front elevation, part cutaway view of an exhaust duct portion of the apparatus of FIG. 1A.

FIG. 2A is a front elevation, part cutaway view of an exhaust duct portion of the apparatus of FIG. 1A. As seen in FIG. 2A, a flow control mechanism 40 is disposed in the exhaust duct 30 in a position downstream from the vent ports. A damper 50 is disposed in the exhaust duct further downstream from the vent ports.

FIG. 2B is a section view of the apparatus of FIG. 2A, taken along section line C of FIG. 2A. As seen in FIG. 2B, in one embodiment flow control mechanism 40 comprises a first duct flange 42*a*, an orifice plate 44, and a second duct flange 42*b*, which are held in fixed relation by a plurality of fasteners 46. Orifice plate includes a hole 48 that is smaller than the diameter of exhaust duct 30. In one embodiment, as an example and not by way of limitation, exhaust duct 30 has a diameter of 3 inches (7.5 cm) and hole 48 has an approximate diameter of 1 inch (2.54 cm). In one embodiment, as an example and not by way of limitation, flanges 42*a*, 42*b* and plate 44 are formed of 12-gauge stainless steel, and fasteners 46 each comprise a 5/32" bolt, washer and nut. In combination, flow control mechanism and damper 50 reduce and limit static pressure and airflow in the system. The complete system is capable of removing emitted vapors and preventing the vapors from being induced into the workspace.

As an alternative to a flow control mechanism having a fixed orifice, an adjustable flow control mechanism may be used, enabling a technician to choke or release pressure of vapors passing through the vent duct. There is no limit or requirement on how close or far the damper or flow control mechanism need to be with respect to the vent ports, except that the flow control mechanism is preferably downstream from the vent ports. In this context, "downstream" means in the direction of the exhaust fan or external exhaust location.

Any number of vent ports may be provided and any number of chemical vessels may be coupled to the vent header. When the vent header is used in an HPLC environment, typically four (4) vent ports are provided for each HPLC unit. The vent duct, exhaust duct and other components of the apparatus may be formed of galvanized sheet steel, in one embodiment. Other materials that are impervious to the chemicals in the chemical vessels, and their vapors, may be used.

One or more static pressure sensors, such as those of the magnehelic type, may be mounted adjacent to the vent header for visual observation for monitoring purposes.

When vent duct is formed with a rectangular cross-section, the surface bearing the vent ports may be approximately 2¾" tall and the vent header may be approximately 1½" wide, although these dimensions are not critical, and are provided as an example and not by way of limitation.

Figure 3A:
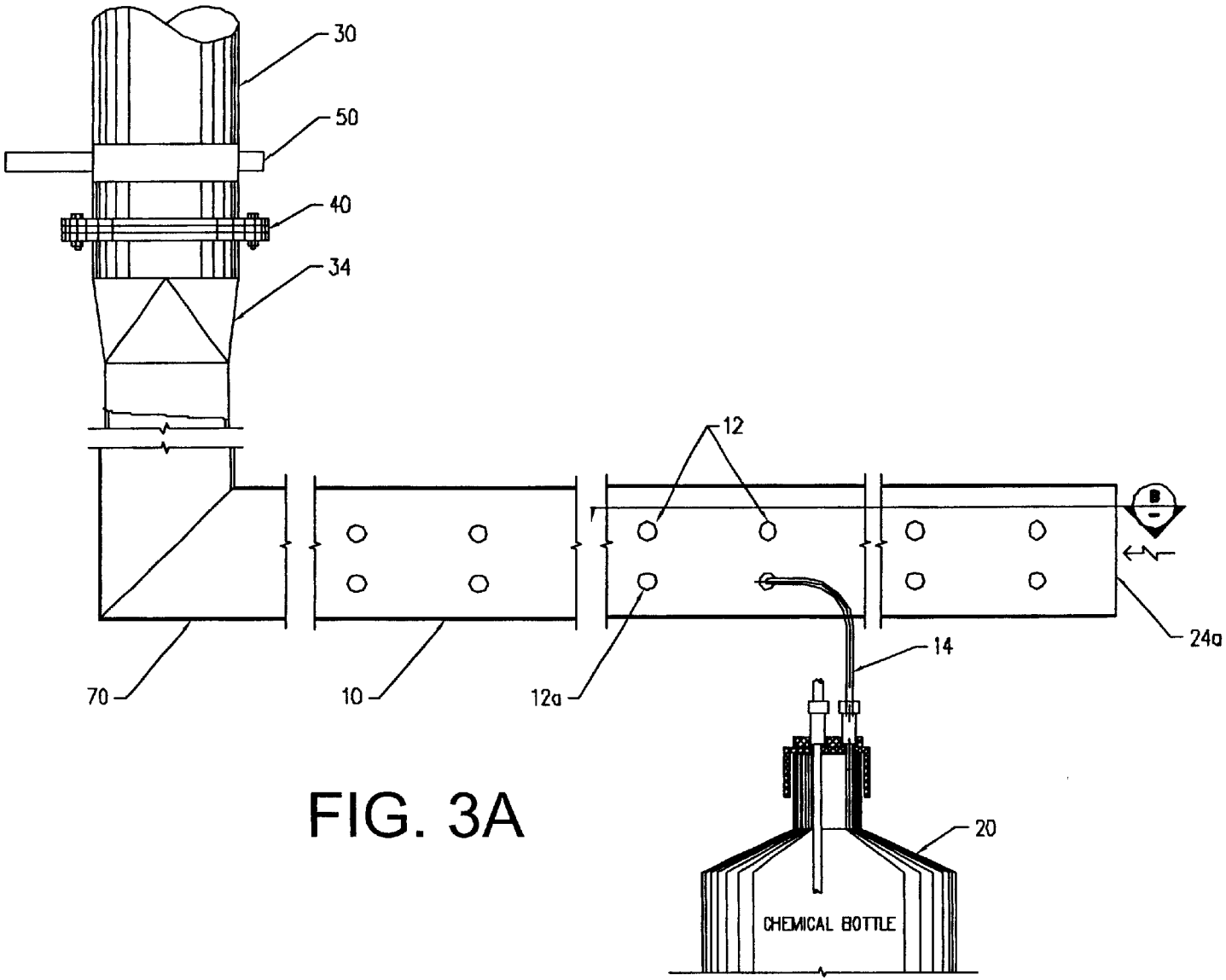
FIG. 3A is a front elevation view of a venting apparatus, according to a second embodiment.

FIG. 3A is a front elevation view of a venting apparatus, according to a second embodiment. As in FIG. 1A, a vent header 10 features vent ports 12 that are coupled by tubing to vessel 20. In the embodiment of FIG. 3, however, vent header 10 is joined by an elbow segment 70 to transition section 34. As in FIG. 1A, transition section 34 is joined to exhaust duct 30, which has flow control mechanism 40 and damper 50. Vent header 10 has one open end 24*a* that receives room air, providing a draft. The embodiment of FIG. 3 is therefore suitable for situations in which the exhaust duct 30 is best positioned at one end of a laboratory or furnishing.

Figure 3B:
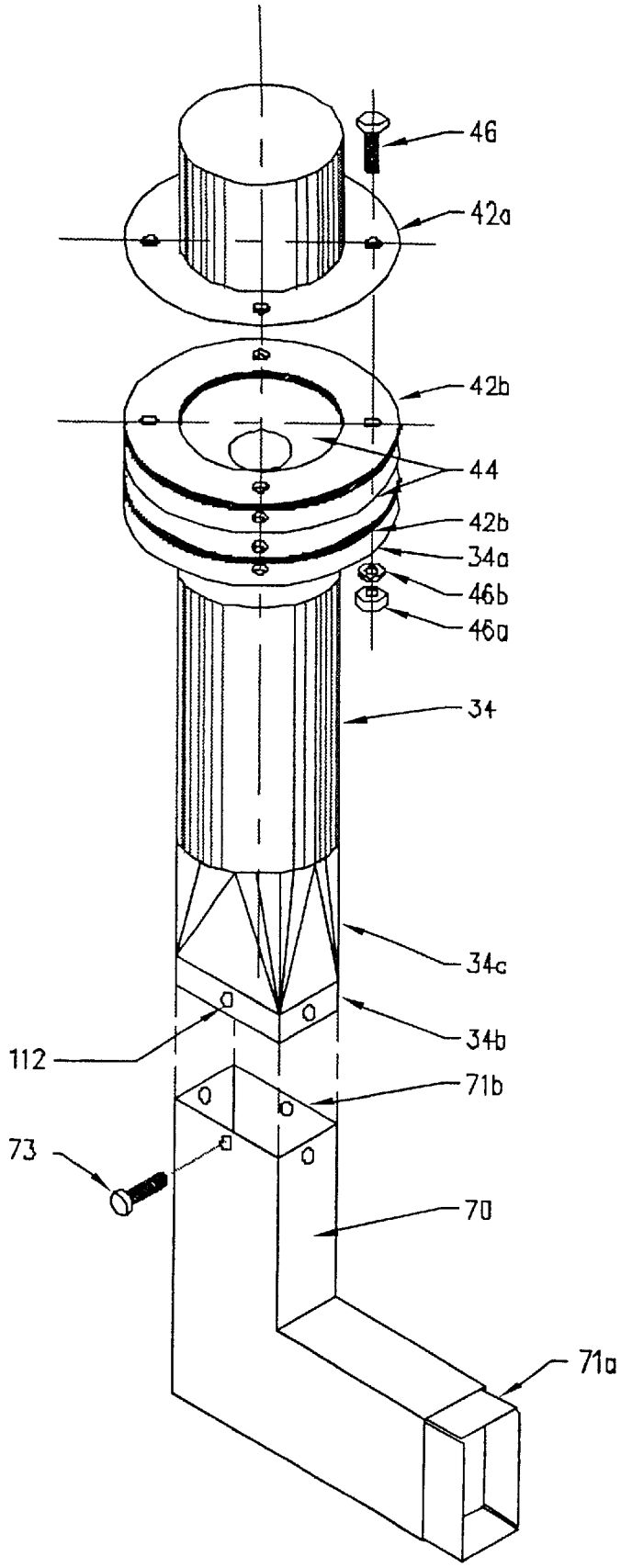
FIG. 3B is a perspective view of an example construction of an elbow portion that may be used with the embodiment of FIG. 3A.

FIG. 3B is a perspective view of an alternative construction of an elbow portion of the embodiment of FIG. 3A. As seen in FIG. 3B, elbow segment 70 may comprise a closed rectangular box having a first end 71*a* that mates with an end of vent header 10 by snugly sliding into it. One or more mechanical fasteners may be affixed to elbow segment 70 to enable securing the elbow section to furnishings, as described further below. A second end 71*b* mates with lower end 34*b* of transition section 34, and elbow segment 70 may be affixed to transition section 34 using one or more fasteners 73. The transition section 34 may further comprise a base flange 34*a* that is joined, by fasteners 46, to flange 42*a*, two (2) gaskets 42*b* and plate 44. Fasteners 46 may include washers 46*b* and nuts 46*a*.

Figure 3C:
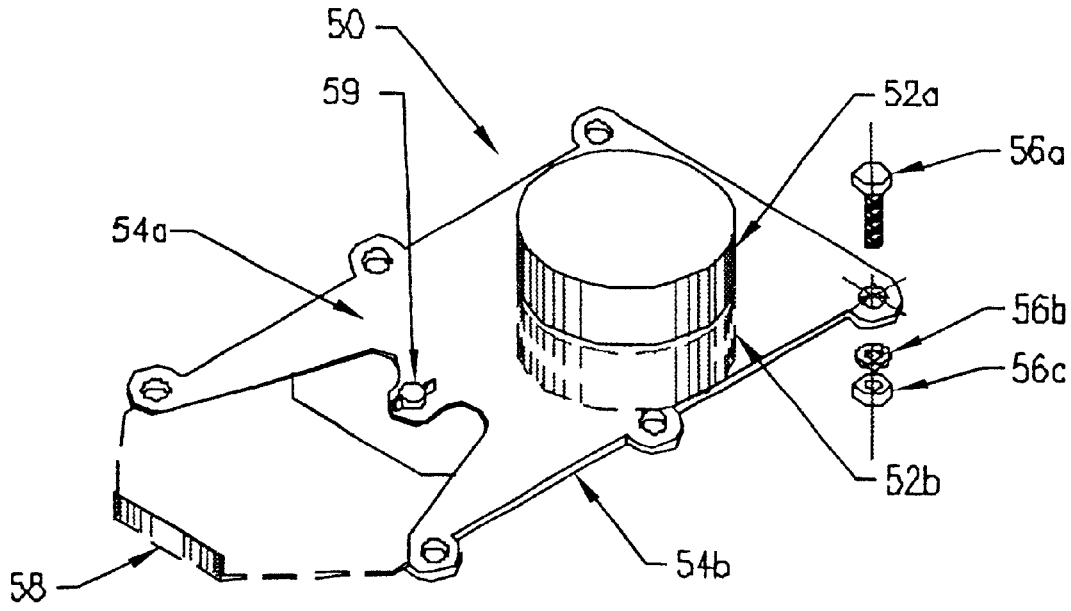
FIG. 3C is a perspective view of a damper that may be used in the embodiment of FIG. 3A.
Figure 3D:
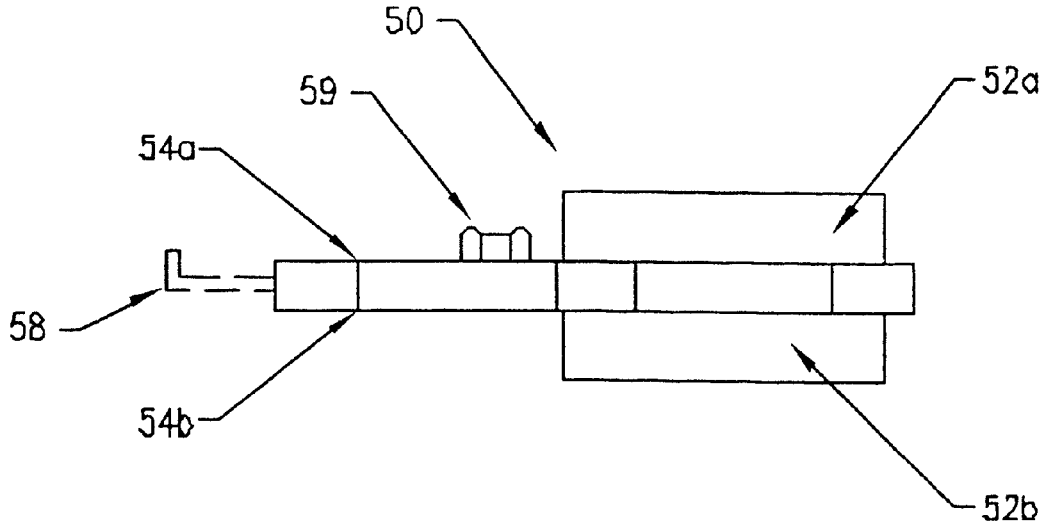
FIG. 3D is a side elevation view of the damper of FIG. 3C.

FIG. 3C is a perspective view of a damper that may be used in the embodiment of FIG. 3A. FIG. 3D is a side elevation view of the damper of FIG. 3C. In this embodiment, damper 50 comprises upper and lower flanges 52*a*, 52*b* that project respectively from upper and lower plates 54*a*, 54*b*. Flanges 52*a*, 52*b* and plates 54*a*, 54*b* define a hole extending there through. The plates are held together in a spaced-apart relationship, such that a sliding gate 58 may move between them, by a plurality of fasteners 56*a*, such as bolts with corresponding washers 56*b* and nuts 56*c*. Thus, movement of gate 58 within plates 54*a*, 54*b* selectively controls whether the hole extending through flanges 52*a*, 52*b* and the plates is fully open, partially obstructed, or fully closed. Gate 58 may be retained in a particular position by moving the gate to the desired position and tightening stopping screw 59.

In this arrangement, flanges 52*a*, 52*b* are affixed in an exhaust duct 30 (as in FIG. 1A) and are held therein by appropriate fasteners or any other suitable mechanical means. Accordingly, flow of gases, vapors or air through exhaust duct 30 is controlled and adjusted by manually moving gate 58 to a desired position. A suitable damper is commercially made by United McGill.

Figure 4A:
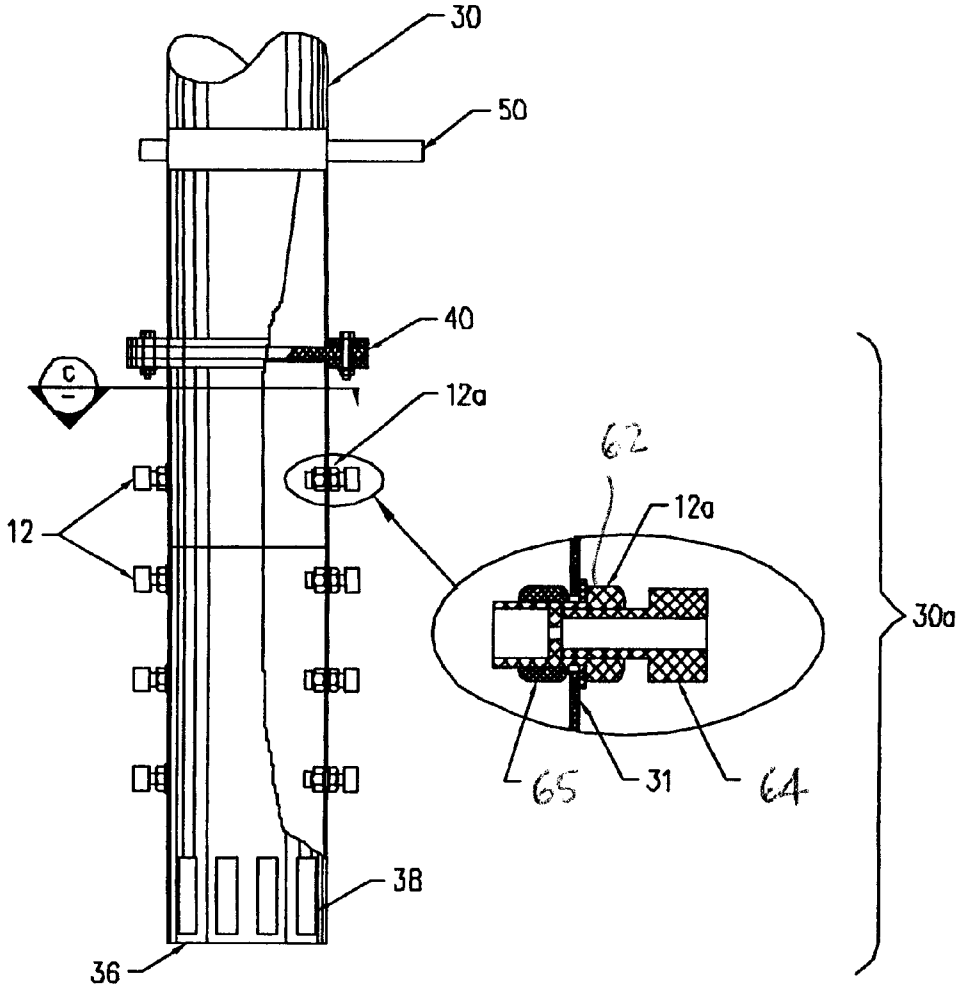
FIG. 4A is a front elevation, part cutaway view of a venting apparatus, according to a third embodiment.
Figure 4B:
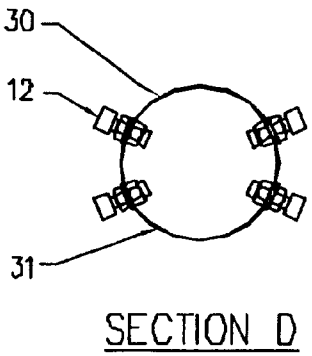
FIG. 4B is a top section view of the embodiment of FIG. 4A, taken along section line D of FIG. 4A.

FIG. 4A is a front elevation, part cutaway view of a venting apparatus, according to a third embodiment. FIG. 4B is a top section view of the embodiment of FIG. 4A, taken along section line D of FIG. 4A. Referring first to FIG. 4A, a venting apparatus comprises a vertically freestanding exhaust duct 30 having a flow control mechanism 40 and damper 50 therein, as in FIG. 1A. In the embodiment of FIG. 4A, however, vent ports 12 are affixed in a lower portion 30*a* of exhaust duct 30, which serves as a vent header. Duct 30 may be a rectangular tube, circular tube, etc.

Exhaust duct 30 further comprises a proximal end 36 having a plurality of slots. Thus, end 36 is open to room air and provides draft in the apparatus, and the slots act as an intake manifold. As in FIG. 1A, each of the ports 12 comprises a fitting 62 that is held against wall 31 of duct 30 by a nut 64. As shown in FIG. 4B, in one embodiment the ports 12 are disposed radially in wall 31 so that chemical bottles may be coupled to the venting apparatus at any position around the venting apparatus.

In an alternative construction of the embodiment of FIG. 4A, FIG. 4B, vent header 10 may be formed as a substantially vertical rectangular tube terminating in a lower end having a plurality of slots. In this arrangement, the lower end provides draft to the venting apparatus through the slots; the lower end may be closed by a lower wall, or open. The slots may be horizontally or vertically oriented. A plurality of spaced-apart vent ports may be provided in one or more walls of the vent header. A transition section may be joined to an upper end of the vent header, and may use the construction shown in FIG. 3B.

Vent header 10 may terminate in an end cap that is attached to the vent header as a sleeve over the vent header, or as a plug that is inserted into the vent header. The end cap may be retained in place with mechanical screws or rivets. The end cap may be perforated with slots, round holes, etc., which perforations serve as an intake for ambient room air.

Figure 5A:
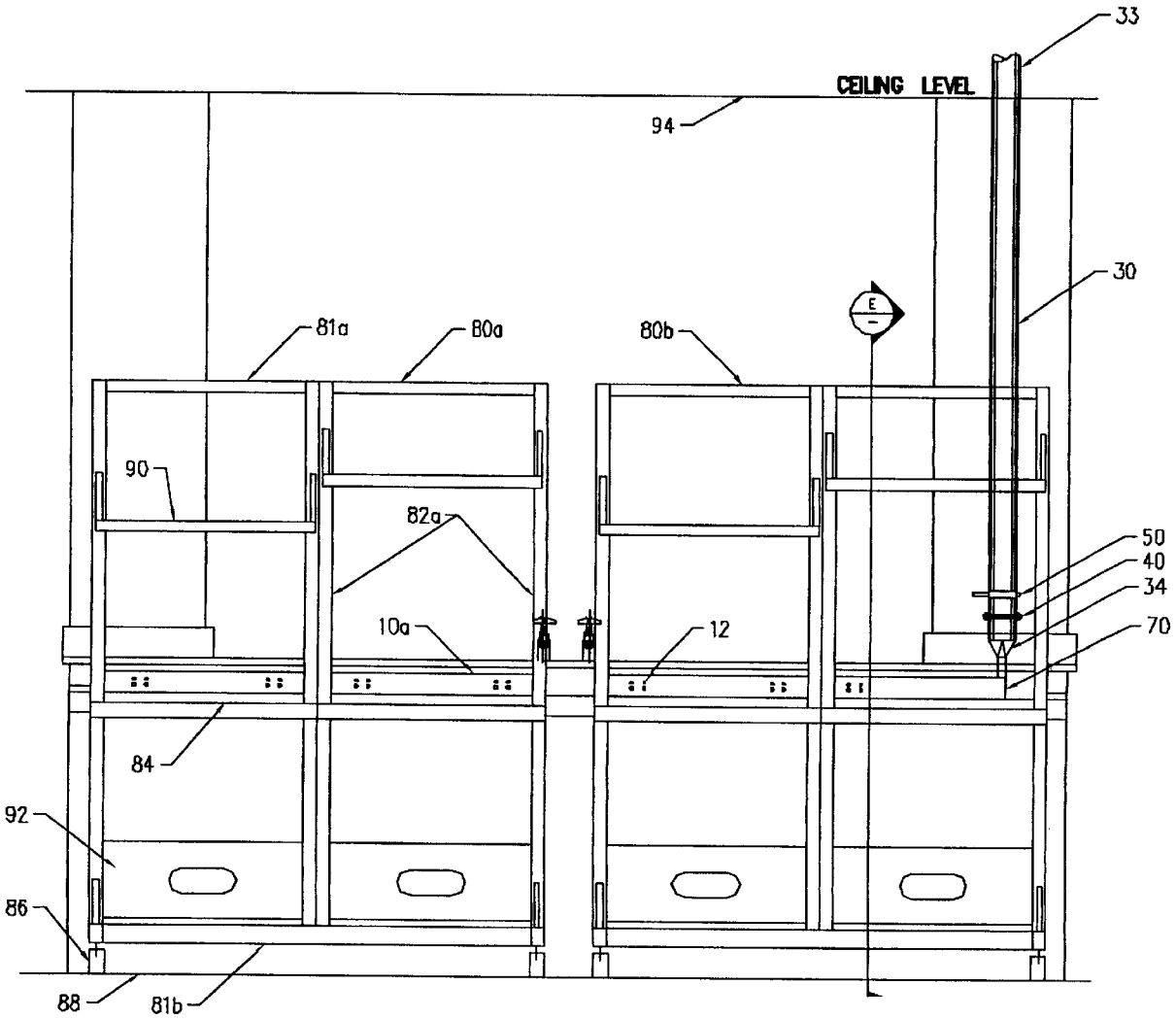
FIG. 5A is a front elevation view of a venting apparatus affixed to and integrated with a workplace furnishing, according to a first embodiment.
Figure 5B:
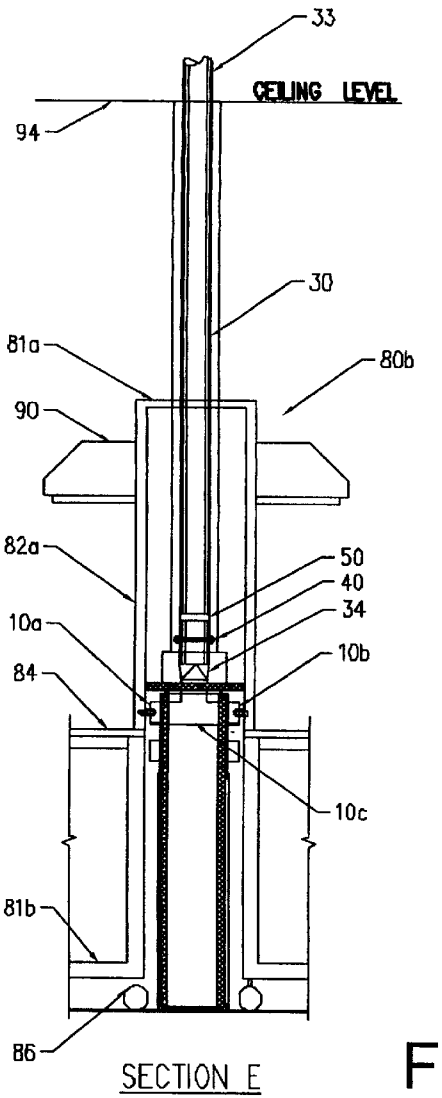
FIG. 5B is a side section view of the embodiment of FIG. 5A, taken along section line E of FIG. 5A.

According to certain embodiments, venting apparatus may be affixed to or integrated into workplace furnishings, such as laboratory benches and the like. FIG. 5A is a front elevation view of a venting apparatus affixed to and integrated with a workplace furnishing, according to a first embodiment. FIG. 5B is a side section view of the embodiment of FIG. 5A, taken along section line E of FIG. 5A.

For purposes of illustrating a simple example, venting apparatus is disclosed herein as attached to workplace furniture units. However, embodiments may be attached to any surface such as a wall, rack, countertop, or any architectural surface.

Referring first to FIG. 5A, a first vent header 10*a* having vent ports 12 is shown affixed to first and second workplace furniture units 80*a*, 80*b*. The specific form, structure and use of the workplace furnishings are not essential to embodiments of the invention; however, for purposes of illustrating a clear example of use of embodiments with such furnishings, a description of suitable furnishings is provided.

Unit 80*a*, for example, comprises upright structural members 82*a* that are affixed to an upper wall 81 a and lower wall 81*b*, forming a rigid frame. Upright members 82*a* terminate in wheels 86 or leveling devices that rest on a floor 88 of the workplace. A generally horizontal, elongated work surface 84 is affixed to the upright members 82*a* for holding chemical bottles, laboratory equipment, and other work materials. One or more rear panels 92 are affixed to upright members 82*a* and lower wall 81*b* to provide structural stability and shear strength. One or more shelves 90 can accommodate equipment or materials.

Vent header 10*a* may be attached to units 80*a*, 80*b* in any of several approaches. In one configuration, hanger brackets are affixed, by spot-welding or the like, to vent header 10*a* at one or more locations along the length of the vent header.

The hanger brackets are hung in corresponding slots that are provided in upright members 82*a* at the rear of the units 80*a*, 80*g*. Existing hanger slots that are provided in the units for hanging modular shelving and the like may be used. Alternatively, vent header 10*a* passes through holes in upright members 82*a*. In either alternative, vent header 10*a* preferably is mounted adjacent to work surface 84 to provide for convenient attachment of chemical bottles that are resting on the work surface to the vent ports.

As in the embodiment of FIG. 3, vent header 10*a* terminates in one open end 24*a* and an elbow segment 70, which is joined to a transition section 34. Exhaust duct 30 is joined to the transition section 34 and includes flow control mechanism 40 and damper 50. A distal end of exhaust duct 33 exits the workspace through or above the ceiling 94 and terminates at an exhaust fan, or terminates at an appropriate exhaust point outside the workspace.

Referring now to FIG. 5B, when either of units 80*a*, 80*b* have two work surfaces on opposite sides, the embodiment of FIG. 5A, FIG. 5B may include first and second vent headers 10*a*, 10*b* arranged on opposite sides of a unit such as unit 80*b*. A tee adapter 10*c* joins the first and second vent headers to transition section 34. Alternatively, transition section 34 and tee adapter 10*c* may be formed integrally as one unit. Exhaust duct 30 extends upwardly from transition section 34 through unit 80*b* and terminates above the ceiling 94 or at an appropriate exhaust point.

Thus, a chemical vapor venting apparatus is efficiently integrated into laboratory furnishings in a compact and unobtrusive manner. For example, the vent header may be formed of sheet metal that is compatible in size with the frame members of the laboratory furnishings so that it blends in with the furnishing units.

Figure 6A:
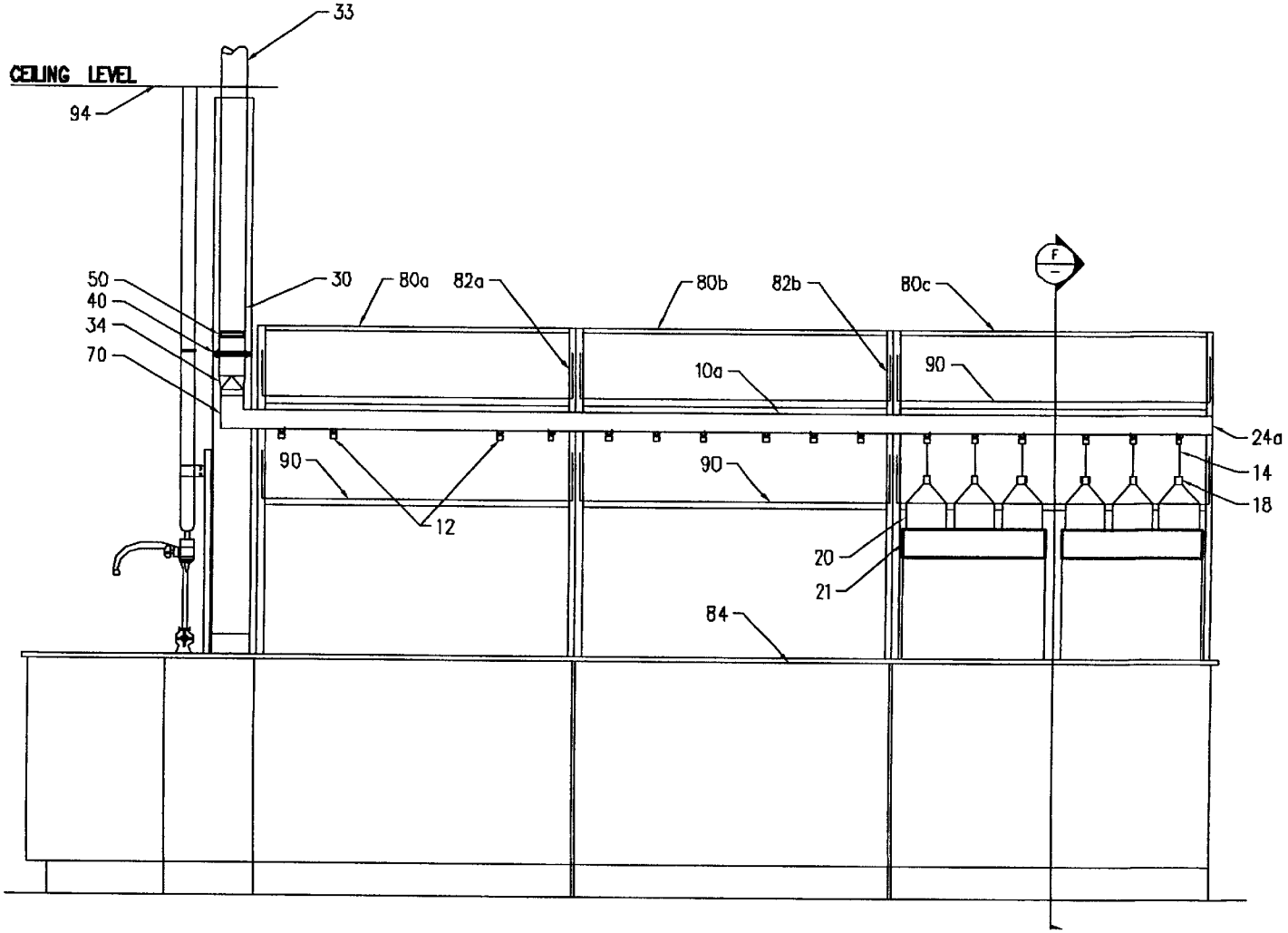
FIG. 6A is a front elevation view of a venting apparatus affixed to and integrated with a workplace furnishing, according to a second embodiment.
Figure 6B:
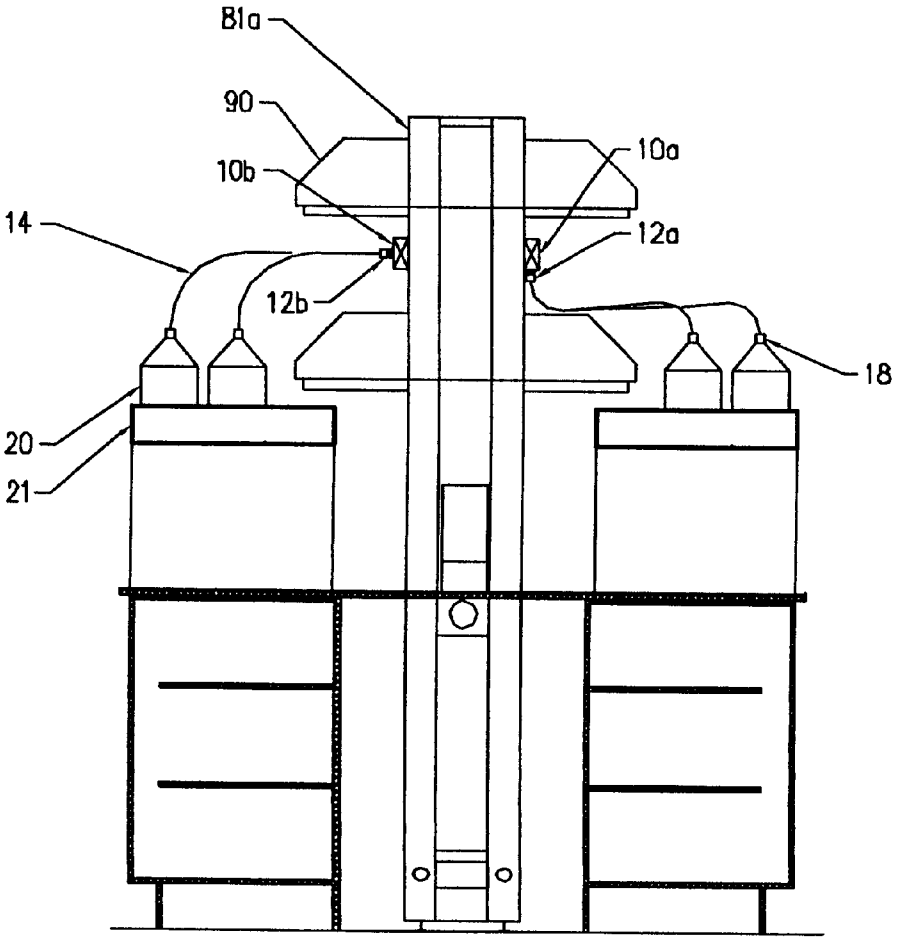
FIG. 6B is a side section view of the embodiment of FIG. 6A, taken along section line F of FIG. 6A.

FIG. 6A is a front elevation view of a venting apparatus affixed to and integrated with a workplace furnishing, according to a second embodiment. FIG. 6B is a side section view of the embodiment of FIG. 6A, taken along section line F of FIG. 6A.

Referring first to FIG. 6A, a first vent header 10*a* having a plurality of vent ports 12 is affixed to one or more upright members 82*a*, 82*b* of one or more units 80*a*, 80*b*. The vent header 10*a* is positioned above one or more shelves 21 for supporting one or more chemical storage vessels 20. For purposes of illustrating a clear example, two (2) shelves 21 and six (6) vessels 20 are shown in FIG. 6A; however, any number may be used.

A distal end of vent header 10*a* terminates in an elbow segment 70 and a proximal end 24*a* is open to room air to provide draft. Optionally, end 24*a* may have a grate or screen to prevent introduction of foreign matter into vent header 10*a*. A transition section 34 joins vent header 10*a* to an exhaust duct 30 that exits the room above ceiling level, as indicated by upper end 33. Exhaust duct 30 includes a flow control mechanism 40 and damper 50.

In this arrangement, chemical storage vessels 20 are conveniently attached to vent ports 12 using tubing 14. Other ports in caps 18 of the storage vessels 20 may connect to HPLC equipment (not shown) or other apparatus that uses chemicals in the storage vessels. Work surface 84 is kept clear for other uses.

As seen in FIG. 6B, unit 80*a* may have two opposite work areas and therefore a first vent header 10*a* and second vent header 10*b* may be affixed to opposite sides of the unit. Further, vent ports 12 may extend either downwardly, as shown in the case of first vent header 10*a* and in FIG. 6A, or outwardly, as shown in the case of second vent header 10*b*. First and second vent headers 10*a*, 10*b* may be affixed to unit 80*a* using fasteners such as screws, appropriate hanger brackets that are compatible with corresponding slots in upright members 82*a*, by spot-welding, etc.

Figure 7A:
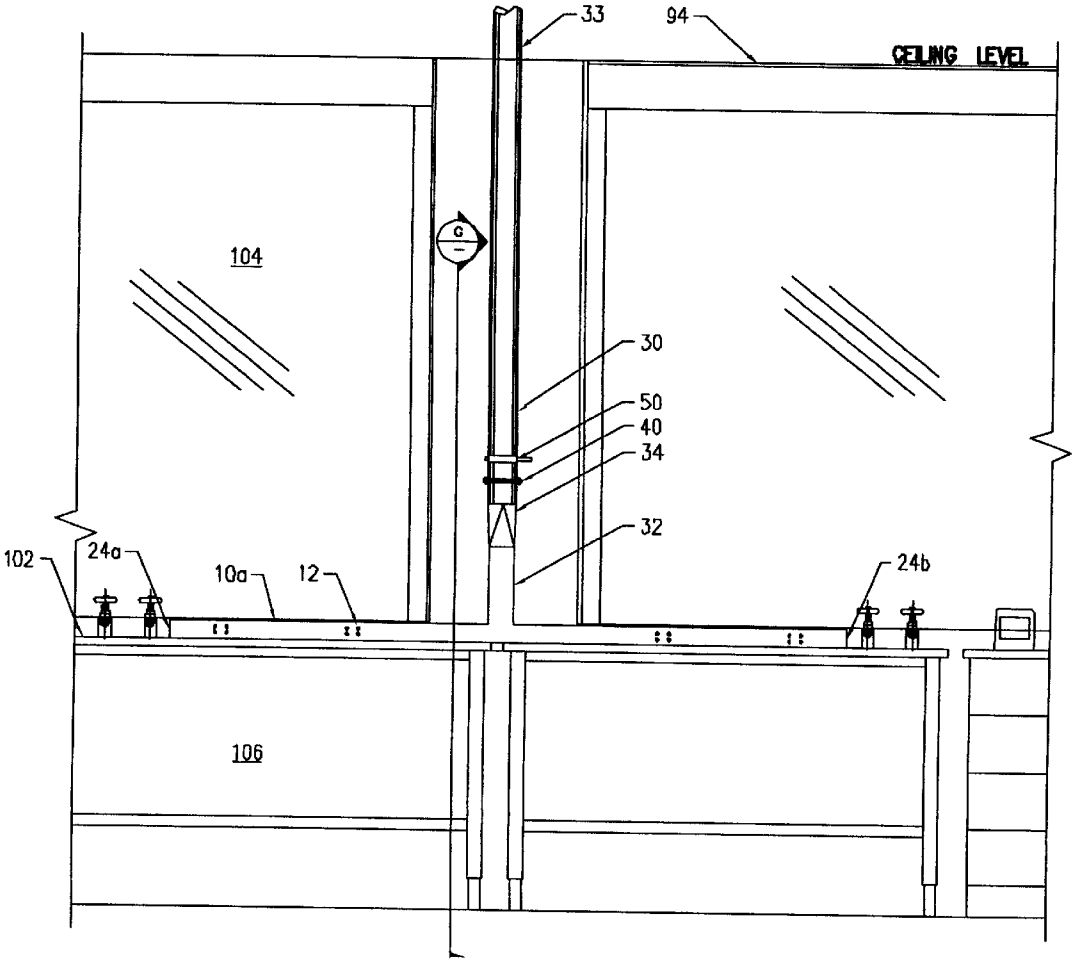
FIG. 7A is a front elevation view of a venting apparatus affixed to and integrated with a workplace furnishing, according to a third embodiment.
Figure 7B:
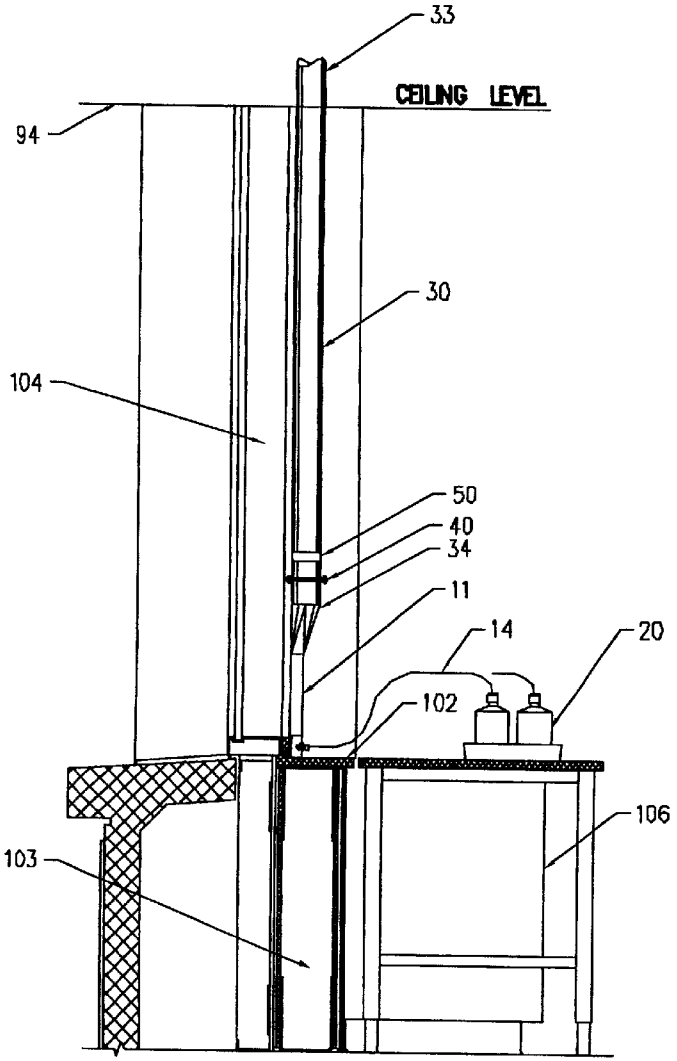
FIG. 7B is a side section view of the embodiment of FIG. 7A, taken along section line G of FIG. 7A.

FIG. 7A is a front elevation view of a venting apparatus affixed to and integrated with a workplace furnishing, according to a third embodiment. FIG. 7B is a side section view of the embodiment of FIG. 7A, taken along section line G of FIG. 7A.

Referring first to FIG. 7A, a vent header 10 is mounted on or adjacent to a ledge 102 that is mounted on the wall 104 of a workspace. The ledge 102 may have a supporting structure 103, as seen in FIG. 7B, which may be freestanding or attached to the wall 104. Vent header 10 may be affixed to either the ledge 102 or wall 104, or both, using suitable fasteners such as screws. In this arrangement an equipment table 106 or cart is typically placed adjacent to the ledge 102 to support one or more chemical storage vessels 20 in close proximity to the ledge, and tubing 14 couples the vessels to the vent ports 12 of the vent header 10.

Vent header 10 further comprises first and second ends 24*a*, 24*b*. In the embodiment of FIG. 7A, FIG. 7B, both ends 24*a*, 24*b* are open to ambient room air. The ends 24*a*, 24*b* may have caps, grates, or screens to prevent introduction of foreign matter into vent header 10. An upstanding segment 32 joins vent header 10 to transition section 34, which is joined to exhaust duct 30. A flow control mechanism 40 and damper 50 are provided in exhaust duct 30. The distal end 33 of exhaust duct 30 terminates at a point above ceiling level 94, at an exhaust fan, outside the workspace, etc.

5.0 EXTENSIONS AND ALTERNATIVES

In the foregoing specification, the invention has been described with reference to specific embodiments thereof. It will, however, be evident that various modifications and changes may be made thereto without departing from the broader spirit and scope of the invention. Embodiments are presented herein as examples and not by way of limitation. The specification and drawings are, accordingly, to be regarded in an illustrative rather than a restrictive sense.

What is claimed is:

1. A venting apparatus for venting chemical storage vessels, comprising:

a vent duct;

a plurality of vent ports in spaced-apart locations in the vent duct, wherein each of the vent ports is configured to be matable with a chemical storage vessel;

a flow control mechanism disposed in the vent duct downstream from the vent ports; wherein the flow control mechanism includes a plate provided within the vent duct and having a hole therein; and a damper disposed in the vent duct downstream from the vent ports;

wherein the damper and the flow control mechanism are configurable to be used in combination with an exhaust system to move chemical vapors through the vent duct.

2. An apparatus as recited in claim 1, wherein the vent duct further comprises a distal end and a proximal end, wherein the proximal end terminates within a workspace, and wherein the distal end terminates outside the workspace.

3. An apparatus as recited in claim 1, wherein the vent duct further comprises a distal end and a proximal end, wherein the proximal end terminates within a workspace, and wherein the distal end terminates outside the workspace;

wherein the distal end is coupled to an exhaust fan; and wherein the proximal end comprises an intake from the workspace.

4. An apparatus as recited in claim 1, wherein the flow control mechanism comprises a plate mounted perpendicularly within the vent duct and having a hole therein.

5. An apparatus as recited in claim 1, wherein the vent duct comprises a generally vertical exhaust duct section, and a vent header, wherein the exhaust duct section is joined substantially perpendicularly to the vent header.

6. An apparatus as recited in claim 1, wherein the vent duct comprises a generally vertical exhaust duct section, and a vent header, wherein the exhaust duct section is joined substantially perpendicularly to the vent header;

wherein the flow control mechanism and the damper are in the exhaust duct section; and wherein the vent ports are in the vent header.

7. An apparatus as recited in claim 1, wherein each of the vent ports comprises a bulkhead union mounted perpendicularly in the vent header and having a hole therein.

8. An apparatus as recited in claim 1, wherein the damper comprises two flanged plates mounted perpendicularly within the vent duct, and having a sliding gate between the flanged plates for airflow control.

9. An apparatus as recited in claim 1, wherein the vent duct is formed as a circular tube, and wherein the vent ports are disposed radially in the vent duct.

10. An apparatus as recited in claim 1, wherein the vent duct is formed as a rectangular tube, and wherein the vent ports are disposed on one planar surface of the vent duct.

11. An apparatus as recited in claim 1, wherein the vent duct is affixed to a surface that is capable of concurrently supporting one or more of the chemical vessels.

12. An apparatus as recited in claim 1, wherein the vent duct is integrally formed as part of furniture that is capable of concurrently supporting one or more of the chemical vessels.

13. A workplace furnishing having an integrated venting apparatus, comprising:

a frame having one or more surfaces for supporting one or more chemical storage vessels;

a vent duct affixed to the frame;

a plurality of vent ports in spaced-apart locations in the vent duct, wherein each of the vent ports is adapted for coupling to a chemical storage vessel;

a flow control mechanism disposed in the vent duct downstream from the vent ports, wherein the flow control mechanism comprises a plate mounted perpendicularly within the vent duct and having a hole therein; and a damper disposed in the vent duct downstream from the vent ports.

14. A workplace furnishing as recited in claim 13, wherein the vent duct further comprises a distal end and a proximal end, wherein the proximal end terminates within a workspace, and wherein the distal end terminates outside the workspace.

15. A workplace finishing as recited in claim 13, wherein the vent duct further comprises a distal end and a proximal end, wherein the proximal end terminates within a workspace, and wherein the distal end terminates outside the workspace;

wherein the distal end is coupled to an exhaust fan; and wherein the proximal end comprises an intake from the workspace.

16. A workplace furnishing as recited in claim 13, wherein the vent duct comprises a generally vertical exhaust duct section, and a vent header, wherein the exhaust duct section is joined substantially perpendicularly to the vent header.

17. A workplace furnishing as recited in claim 13, wherein the vent duct comprises a generally vertical exhaust duct section, and a vent header, wherein the exhaust duct section is joined substantially perpendicularly to the vent header;

wherein the flow control mechanism and the damper are in the exhaust duct section; and wherein the vent ports are in the vent header.

18. A workplace furnishing as recited in claim 13, wherein the vent duct is formed as a circular tube, and wherein the vent ports are disposed radially in the vent duct.

19. A workplace furnishing as recited in claim 13, wherein the vent duct is formed as a rectangular tube, and wherein the vent ports are disposed on one planar surface of the vent duct.

20. A venting apparatus, comprising:

means for conveying chemical vapors from an internal environment to an external environment;

means, disposed in spaced-apart locations in the conveying means, for coupling the conveying means to one or more chemical storage vessels;

means disposed in the conveying means, downstream from the coupling means, for controlling a flow of the vapors from the internal environment to the external environment, wherein said controlling means comprises a plate mounted perpendicularly within the vent duct and having a hole therein; and means disposed in the conveying means downstream from the coupling means for damping the flow of the vapors.

21. An apparatus as recited in claim 20, wherein the conveying means is configured for conveying the chemical vapors to a treatment system.

22. An apparatus as recited in claim 20, wherein the conveying means comprises a generally vertical exhaust duct section, and a vent header, wherein the exhaust duct section is joined substantially perpendicularly to the vent header.

23. An apparatus as recited in claim 22, wherein the vent header is affixed to furniture that is capable of concurrently supporting one or more of the chemical vessels.

24. An apparatus as recited in claim 22, wherein the vent header is integrally formed as part of furniture that is capable of concurrently supporting one or more of the chemical vessels.

25. A venting apparatus, comprising:

a vent duct;

a plurality of vent ports in spaced-apart locations in the vent duct, wherein each of the vent ports is adapted for coupling to a chemical storage vessel;

a flow control mechanism disposed in the vent duct downstream from the vent ports;

a damper disposed in the vent duct downstream from the vent ports;

wherein the vent duct comprises a generally vertical exhaust duct section, and a vent header, wherein the exhaust duct section is joined substantially perpendicularly to the vent header;

wherein the flow control mechanism and the damper are in the exhaust duct section;

wherein the vent ports are in the vent header; and wherein each of the vent ports comprises a bulkhead union mounted perpendicularly in the vent header and having a hole therein.

26. A venting apparatus, comprising:

a vent duct;

a plurality of vent ports in spaced-apart locations in the vent duct, wherein each of the vent ports is adapted for coupling to a chemical storage vessel;

a flow control mechanism disposed in the vent duct downstream from the vent ports; and a damper disposed in the vent duct downstream from the vent ports;

wherein the vent duct comprises a generally vertical exhaust duct section, and a vent header, wherein the exhaust duct section is joined substantially perpendicularly to the vent header;

wherein the flow control mechanism and the damper are in the exhaust duct section;

wherein the vent ports are in the vent header; and wherein the damper comprises two flanged plates mounted perpendicularly within the vent duct, and having a sliding gate between the flanged plates for airflow control.

27. An apparatus as recited in claim 26, wherein the vent duct further comprises a distal end and a proximal end, wherein the proximal end terminates within a workspace, and wherein the distal end terminates outside the workspace.

28. An apparatus as recited in claim 26, wherein the vent duct further comprises a distal end and a proximal end, wherein the proximal end terminates within a workspace, and wherein the distal end terminates outside the workspace;

wherein the distal end is coupled to an exhaust fan; and wherein the proximal end comprises an intake from the workspace.

29. An apparatus as recited in claim 26, wherein the flow control mechanism comprises a plate mounted perpendicularly within the vent duct and having a hole therein.

30. An apparatus as recited in claim 26, wherein the vent duct comprises a generally vertical exhaust duct section, and a vent header, wherein the exhaust duct section is joined substantially perpendicularly to the vent header.

31. An apparatus as recited in claim 26, wherein the vent duct comprises a generally vertical exhaust duct section, and a vent header, wherein the exhaust duct section is joined substantially perpendicularly to the vent header;

wherein the flow control mechanism and the damper are in the exhaust duct section; and wherein the vent ports are in the vent header.

32. An apparatus as recited in claim 26, wherein each of the vent ports comprises a bulkhead union mounted perpendicularly in the vent header and having a hole therein.

33. An apparatus as recited in claim 26, wherein the vent duct is formed as a circular tube, and wherein the vent ports are disposed radially in the vent duct.

34. An apparatus as recited in claim 26, wherein the vent duct is formed as a rectangular tube, and wherein the vent ports are disposed on one planar surface of the vent duct.

35. An apparatus as recited in claim 26, wherein the vent duct is affixed to a surface that is capable of concurrently supporting one or more of the chemical vessels.

36. An apparatus as recited in claim 26, wherein the vent duct is integrally formed as part of furniture that is capable of concurrently supporting one or more of the chemical vessels.

37. A venting apparatus, comprising:

a vent duct;

a plurality of vent ports in spaced-apart locations in the vent duct, wherein each of the vent ports is adapted for coupling to a chemical storage vessel;

a flow control mechanism disposed in the vent duct downstream from the vent ports; and a damper disposed in the vent duct downstream from the vent ports;

wherein the vent duct comprises a generally vertical exhaust duct section, and a vent header, wherein the exhaust duct section is joined substantially perpendicularly to the vent header;

wherein the flow control mechanism and the damper are in the exhaust duct section; and wherein the vent ports are in the vent header, and wherein the vent duct is formed as a circular tube, and wherein the vent ports are disposed radially in the vent duct.

* * * * *

UNITED STATES PATENT AND TRADEMARK OFFICE

CERTIFICATE OF CORRECTION

PATENT NO. : 6,672,956 B1
DATED : January 6, 2004
INVENTOR(S) : Rizik Michael

It is certified that error appears in the above-identified patent and that said Letters Patent is hereby corrected as shown below:

Column 11,
Line 59, replace “finishing” with -- furnishing --.

Signed and Sealed this

Thirtieth Day of March, 2004

JON W. DUDAS
*Acting Director of the United States Patent and Trademark Office*